United States Patent [19]

Santilli

[11] Patent Number: 4,702,709

[45] Date of Patent: Oct. 27, 1987

[54] COVER PLATE PLUG RETAINER

[76] Inventor: Michael A. Santilli, 3528 Cotillion, Plano, Tex. 75074

[21] Appl. No.: 870,006

[22] Filed: Jun. 3, 1986

[51] Int. Cl.[4] ..... H01R 13/447; H01R 13/58

[52] U.S. Cl. ..... 439/144; 174/67; 439/145; 439/373; 439/471

[58] Field of Search ..... 339/36, 75 P, 105, 103 R, 339/103 M, 106, 110 P, 123; 174/66, 67

[56] References Cited

U.S. PATENT DOCUMENTS

| | | | |
|---|---|---|---|
| 1,989,823 | 2/1935 | Raabe | 174/66 |
| 2,179,197 | 11/1939 | Raymond | 174/66 |
| 2,610,999 | 9/1952 | Silver | 339/36 |
| 2,710,382 | 6/1955 | Fitzpatrick et al. | 174/67 X |
| 2,722,665 | 11/1955 | Sauder | 339/36 |
| 2,728,058 | 12/1955 | Phalen | 339/75 P |
| 3,097,034 | 7/1963 | Jamrosy | 339/75 P |
| 3,387,254 | 6/1968 | Wheeler | 339/103 R |
| 3,473,859 | 10/1969 | Kircher | 312/209 |
| 4,339,045 | 7/1982 | Bodin | 211/13 |
| 4,340,772 | 7/1982 | Bose | 174/51 |
| 4,355,198 | 10/1982 | Gartland, Jr. | 174/66 |
| 4,484,185 | 11/1984 | Graves | 340/656 |

*Primary Examiner*—Gil Weidenfeld
*Assistant Examiner*—Steven C. Bishop
*Attorney, Agent, or Firm*—Gifford, Groh, VanOphem, Sheridan, Sprinkle and Dolgorukov

[57] ABSTRACT

An electrical plug retainer for a cover plate includes a bracket pivotally mounted with respect to the cover plate mounted over an electrical socket housing. The retaining bracket includes a retaining bar, a pair of parallel legs extending from the ends of the retaining bar, and inwardly extending projections on the free ends of the legs adapted to engage a recess formed in the peripheral edge of the cover plate. Preferably, the retaining bracket conforms with the peripheral shape of the cover plate so that it can be pivoted to lie flush against the wall adjacent the peripheral edge of the cover plate. The retaining bracket can also be pivoted outwardly from the wall for engagement with the electrical cord attached to a plug inserted within the wall socket. In one form of the present invention, the retaining bar includes a cord engagement member. Another embodiment includes a safety device which prevents access to the outlet in a closed position. In addition, a reinforcement plate can be inserted intermediate the cover plate and the projections of the retaining bracket so that any pulling forces applied to the bracket are exerted against the reinforcement plate and distributed throughout the entire face of the cover plate.

20 Claims, 7 Drawing Figures

COVER PLATE PLUG RETAINER

BACKGROUND OF THE INVENTION

I. Field of the Invention

The present invention relates generally to wall mounted electrical plug sockets, and more particularly to an electrical outlet cover plate attachment for retaining the plug within the socket when pulling forces are exerted against the plug.

II. Description of the Prior Art

Electrical socket outlets are well known to provide access to the main power supply of a building. Such outlets are often mounted in a hole formed in a building wall. Once the electrical socket housing has been mounted in the wall, a cover plate is typically secured over the opening so that only the access apertures in the socket face are exposed on the outside of the wall. For example, the cover plate includes an aperture adapted to register with the socket face. Typically, a mounting hole registers with a threaded bore in the electrical housing so that a mounting bolt inserted therethrough mounts the plate over the housing, whereby the edges of the cover plate engage a peripheral wall portion surrounding the hole in the wall. As a result, the previously known cover plate provides a finished appearance to the electrical outlet housing, and prevents exposure of the electrical components within the housing, although a particularly configured plug adapted to be inserted within the access openings of the sockets can be engaged therein.

While the previously known electrical socket outlets permit electrically operated appliances to be operated by merely plugging an appropriate plug into the socket openings, the plug can be easily removed from the socket as well. Thus, when the electrical cord extending between the plug and the appliance is pulled as the appliance is moved away from a wall outlet, the tension in the cord can easily displace the plug from its secure connection within the socket. Although there have been some previously known devices for maintaining the plug in its inserted position in the socket against inadvertant removal, the previously known retainers require extensive modifications to or specialized constructions of the plug, the socket or even the cover plate mounted over the electrical outlet.

A previously known retaining means preventing inadvertant removal of a plug from the socket is shown in the U.S. Pat. No. 2,179,197 to Raymond. Raymond discloses a cover plate having a cross bar extending across the sockets adapted to be received in specially configured recesses in each plug. As a result, such an electrical outlet is not well adapted to receive or retain a conventional plug. As a result, the plug on each appliance must be modified or a special extension cord must be used in conjunction with the cord extending from the appliance in order to utilize such an electrical outlet. Moreover, even though an extension cord would be prevented from being pulled out of the socket, the connection between the plug on the appliance cord and the socket at the end of the extension cord is not retained against inadvertant removal.

Moreover, while there are known attachments for electrical outlet cover plates, none are well adapted to positively retain the plug within the socket as the electrical cord is pulled in the direction away from the electrical outlet. Moreover, while U.S. Pat. No. 4,335,863 to Rapps and U.S. Pat. No. 4,339,045 to Bodin disclose attachments for switch cover plates, such attachments protrude outwardly from the cover plate regardless of whether they are being used, and the references do not teach or suggest that the attachments are useful for retaining a plug in a wall mounted electrical socket.

SUMMARY OF THE PRESENT INVENTION

The present invention overcomes all of the above mentioned disadvantages by providing a retaining bracket attachment for cover plates adapted to engage the electrical cord to which the plug is attached and prevent inadvertant removal of the plug from the socket. The retaining bracket comprises a retaining bar having a pair of legs extending substantially parallel from the ends of the bar, and means for pivotally securing the bracket to the cover plate. The bracket is configured to extend peripherally about a portion of the cover plate against the building wall in a first pivot position, and extends outwardly from the building wall in a second pivot position.

Preferably, the free end of each leg includes an inwardly extending projection adapted to be received in a recess or cut out formed in the edge of the cover plate, whereby the projections are retained between the cover plate and peripheral portion of the building wall around the opening in which the electrical outlet is secured. Preferably, the means for pivotally securing the bracket with respect to the cover plate is aligned in registration with the means for mounting the cover plate to the outlet so that the cover plate is not deformed by forces exerted upon the retaining bracket.

In the preferred embodiment, the retaining bracket can be used by merely winding a cord about the retaining bar in the bracket before the plug is inserted in the wall socket. Alternatively, engagement means such as a cord engaging clip can be used to secure the cord with respect to the retaining bracket so that pulling forces on the cord are applied against the retaining bar rather than the plug engaged in the socket. The preferred embodiment of the present invention also includes reinforcement plates which can be secured behind the cover plate so that forces exerted against the retaining bar are distributed throughout the cover plate rather than concentrated at the point at which the legs are pivotally secured with respect to the plate.

Another preferred embodiment includes a safety device which, in a closed position, prevents access to the electrical outlet. This has the obvious advantage of protecting young children from accidental electrocution or shock. In an open position, holes in the safety device or mask align with the holes of the electrical outlet, thereby permitting use. The bracket is mounted to the sliding mask and slides with the mask in elongated slots in the cover plate, thus performing its function.

Thus, the present invention provides a simple yet effective means for retaining an electrical plug within an electrical socket despite tension upon the electrical cord which tends to pull the plug from the socket. Moreover, the bracket can be conveniently positioned flush against the wall so that it does not obstruct the space along the wall and, simultaneously, the mask means slides over the electrical outlet to prevent inadvertant tampering when not in use. Moreover the bracket can be used with conventional cover plates for electrical outlets without substantial modification, and does not require modification of the plug which is to be inserted in the electrical outlet. These and other advantages of the present invention will be made evident from the following detailed description.

BRIEF DESCRIPTION OF THE DRAWING

The present invention will be more clearly understood by reference to the following detailed description of a preferred embodiment when read in conjuntion with the accompanying drawing in which like reference characters refer to like parts throughout the views and in which.

DETAILED DESCRIPTION OF A PREFERRED EMBODIMENT OF THE PRESENT INVENTION

Figure 1:
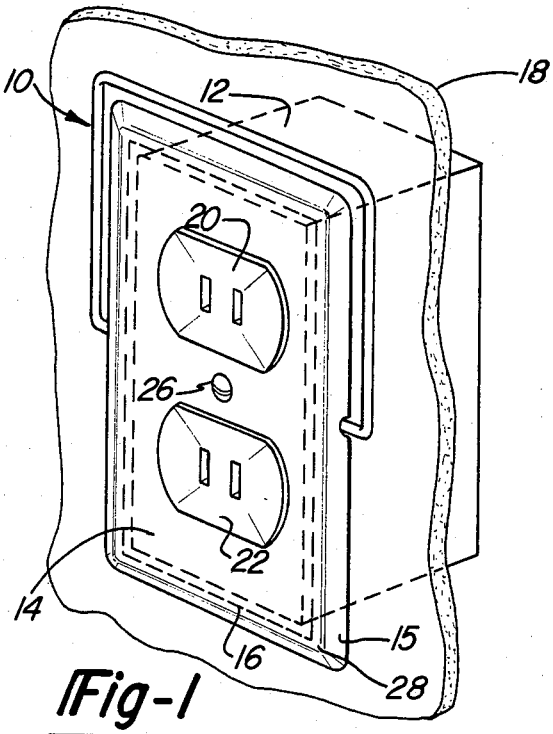
FIG. 1 is a perspective view of an electrical outlet cover plate employing a retaining bracket of the present invention.

Referring first to FIG. 1, a retaining bracket 10 according to the present invention is thereshown mounted for use with an electrical outlet housing 12 covered by a cover plate 14. The electrical outlet housing 12 is mounted within an opening or recess 16 in a building wall 18 by appropriate means (not shown). The housing 12 includes a pair of electrical sockets 20 and 22 having apertures adapted to receive the blades of a plug 24 (FIG. 2) in a well known manner. The plate 14 includes apertures through which the sockets 20 and 22 extend so as to be accessible exteriorly of the wall 18. The plate 14 also includes an aperture adapted to receive a mounting bolt 26 for securing the cover plate 14 to the housing 12, whereby it tightly engages a peripheral wall portion 28 surrounding the recess 16. The cover plate 14 may be of conventional construction, including a substantially flat face surface and a rearwardly curved peripheral edge 15, or may contain the safety mask means to be described in more detail hereinafter.

Figure 3:
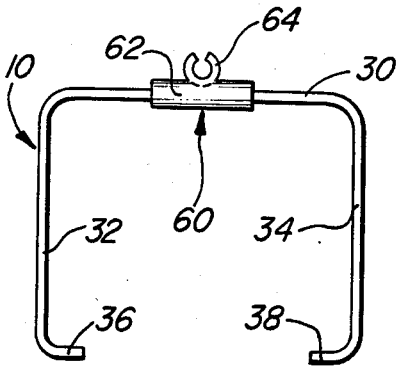
FIG. 3 is a front view of the retaining bracket shown in FIGS. 1 and 2 and showing a modification thereof.

As best shown in FIG. 3, the retaining bracket 10 comprises a retaining bar 30 and parallel legs 32 and 34 extending downwardly from the ends of the bar 30. The free ends of the legs 32 and 34 include inwardly extending projections 36 and 38 respectively. The retaining bar 30, legs 32 and 34 and the projections 36 and 38 can be integrally formed from a bent rod or the like.

Figure 2:
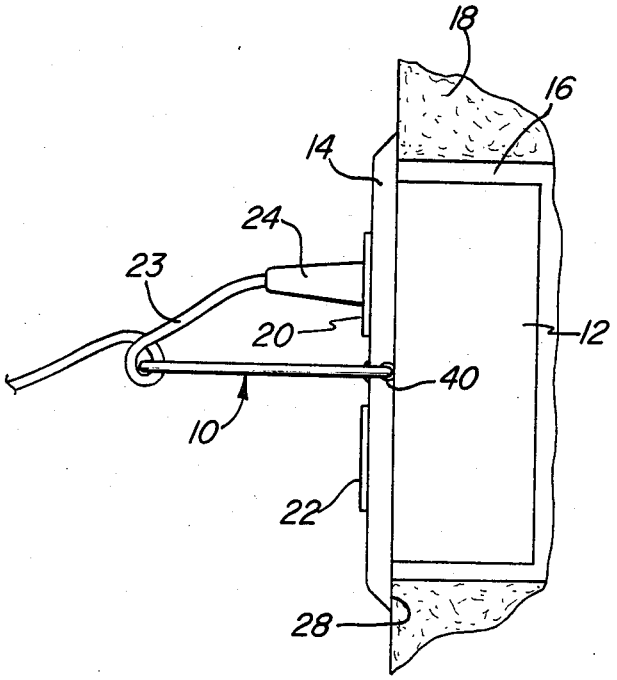
FIG. 2 is a side view of the apparatus shown in FIG. 1 with the retaining bracket shown in its operative position.

Referring now to FIG. 2, the bracket 10 is pivotally secured with respect to the cover plate 14 by insertion of the projections 36 and 38 within openings or recesses 40 formed in opposing edges 15 of the cover plate 14. As a result, it will be understood that the retaining bracket 10 is entrained at one end between the cover plate 14 and the peripheral wall portion 28 and is pivotable between the position shown in FIG. 1 and the position shown in FIG. 2. Of course, it is to be understood that the legs 32 and 34 are of sufficient length to permit the retaining bar 30 to lie adjacent the top or bottom of the cover plate adjacent the edge 15 so that the bracket 10 can lie flush against the wall 18 when not in use.

As shown in FIG. 2, the retaining bracket 10 can be used in a simple manner by looping a portion of the electrical cord 23 to which the plug 24 is attached about the retaining bar 30. Preferably, the loop is positioned along the cord 23 so that the plug 24 can be fully inserted within the socket 20 or 22 without any tension on the intermediate portion of the electrical cord 23.

Referring again to FIG. 3, a modification according to the present invention is thereshown comprising a cord engaging means in the form of a bracket 60. The bracket 60 includes a base 62 adapted to be secured to the retaining bar 30, and a pair of curved fingers 64 extending upwardly from the base 62 in a semi-circular arrangement to resiliently engage the electrical cord 23 therebetween. Means for securing the base 62 to the retaining bar 30 can be constructed in a similar manner. Thus, it will be understood that any tension applied to the cord 23 is therefore resisted by the bracket 60 and the retaining bracket 10. Preferably, the engagement bracket 60 is made of a resilient material such as plastic, so as to avoid damage to the cord 23, and it can be used in lieu of or in conjunction with the loop as shown in FIG. 2.

Figure 4:
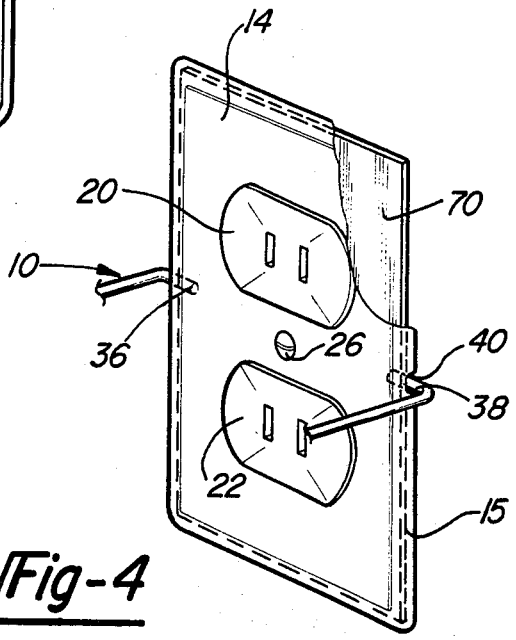
FIG. 4 is a perspective view similar to FIG. 1 and showing a further modification according to the present invention.

Referring now to FIG. 4, it is to be understood that the retaining bracket 10 according to the present invention can be used with a wide variety of conventionally available cover plates regardless of the material from which they are made. It will be understood that some cover plates 14 are made of a thin metal and thus subject to deformation if forces exerted against the retaining bracket 10 are applied to the cover plate 14 at the recesses 40. On the other hand, cover plates 14 which may be made of a brittle plastic material will be subject to fracturing upon the application of such forces. As a result, the present invention includes the use of a reinforcement plate 70 which is dimensioned smaller than the face area of the cover plate 14 so that it engages a substantial surface area on the inside of the face portion of the cover plate 14. Of course, the reinforcement plate 70 includes socket faces receiving aperture and mounting holes corresponding to those in the plate 14. Moreover, the projections 36 and 38 on the retaining bracket 10 extend behind the reinforcement plate 70 so that any pulling forces exerted on the bracket 10 are resisted by the reinforcement plate 70 and distributed throughout the entire cover plate 14.

In any event, it is preferable that the means for pivoting the bracket 10, such as the recesses 40, be aligned with the means for mounting the cover plate 14 against the wall 18 so that the mounting means also serves to resist the tension exerted on a retaining bracket 10 as it is pulled by the cord 23. Thus, as shown in FIGS. 1 and 4, the recesses 40 are aligned in registration with the mounting bolt hole 26.

Figure 5:
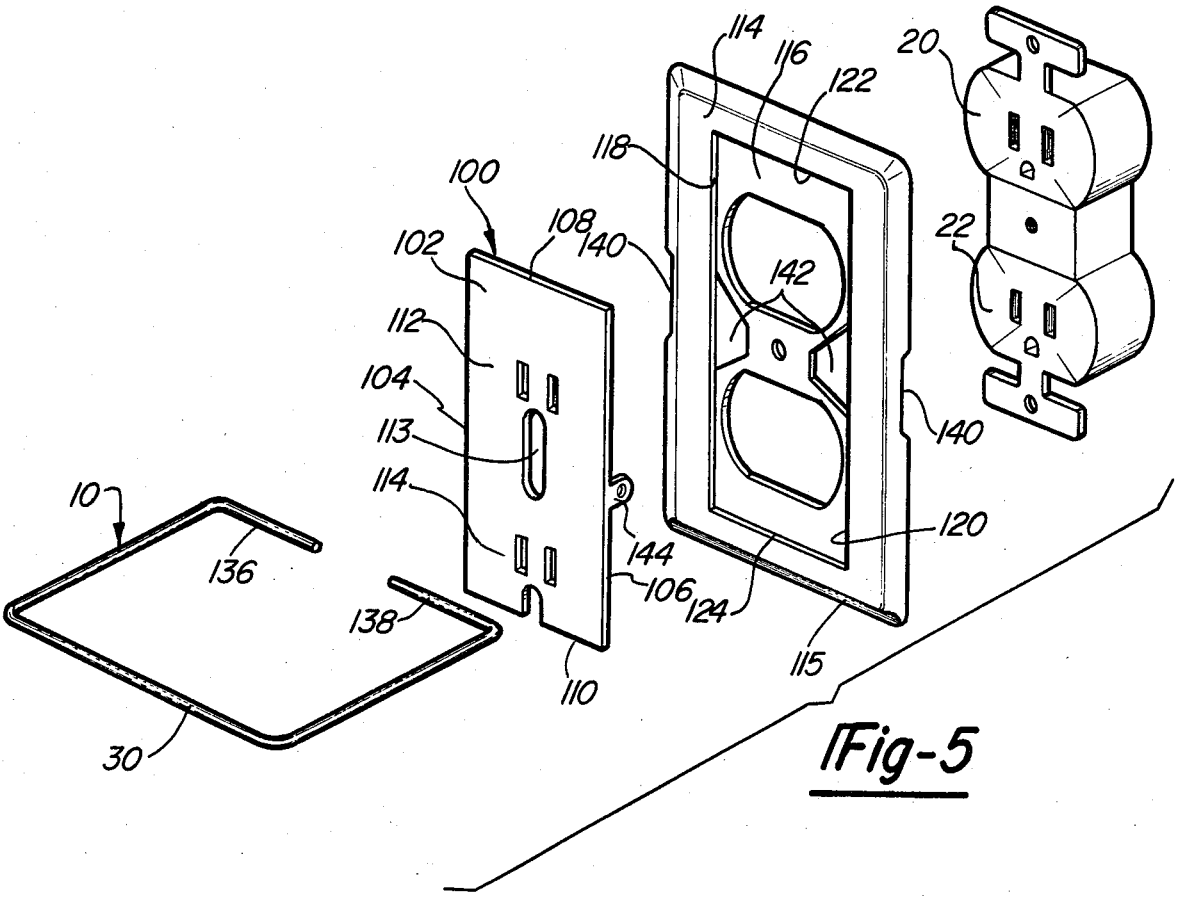
FIG. 5 is an exploded perspective view of a preferred embodiment showing the safety mask means.

Referring now to FIGS. 5 and 6, a preferred embodiment is shown employing a cover plate 114 with a safety device 100. The electrical sockets 20, 22 are the same as shown in FIG. 1. The cover plate 114, however, contains a recess 116 defined by edges 118, 120, 122 and 124. Additionally, recesses 140 in the peripheral edge of the cover plate 114 are elongated, and extend toward the center, creating spaces 142 in cover plate 114.

Safety device 100 comprises a mask plate 102 having parallel edges 104 and 106, top edge 108 and bottom edge 110. The mask plate 102 also contains two groupings of holes 112 which correspond to the holes of electrical sockets 20, 22. The central hole 113 of grouping 112 is elongated to provide access to mounting bolt 26 as well the grounding hole of socket 20. The back side of mask plate 102 contains two brackets 144 which are adapted to pivotally receive projections 136, 138 of the bracket 10.

The mask plate 102 is dimensioned so that parallel edges 104, 106 are shorter than, but frictionally engage recess edges 118, 120, thus allowing the mask plate 102 to slide up and down within the recess 116. Brackets 144 fit into spaces 142 and the mask plate is held in place by inserting the projections 136, 138 through elongated recesses 140 and into brackets 144. In addition, correspondingly bevelled edges (not shown) could be used to retain the mask plate 102 in the cover plate 114.

The lower peripheral edge 115 of the cover plate 114 is adapted to frictionally engage retaining bar 30 of bracket 10 when the mask plate 102 is in the lower position and the bracket 10 is pressed down under peripheral edge 115. In this way there are no projecting parts to obstruct the space along the wall as shown in FIG. 6A.

Figure 6A:
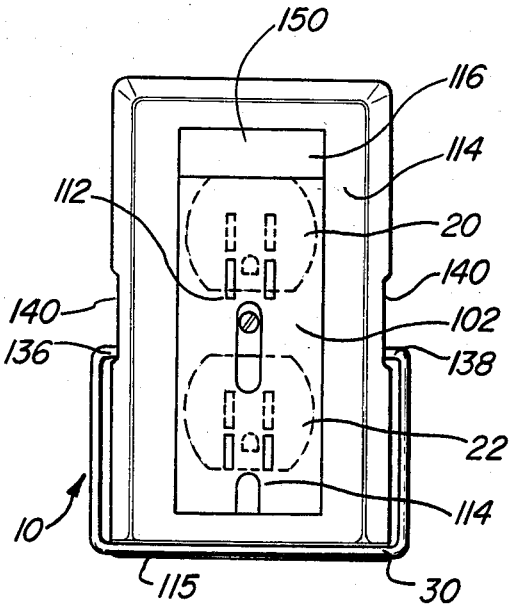
FIGS. 6A and 6B are front plan views showing the safety mask in the closed and open positions, respectively.
Figure 6B:
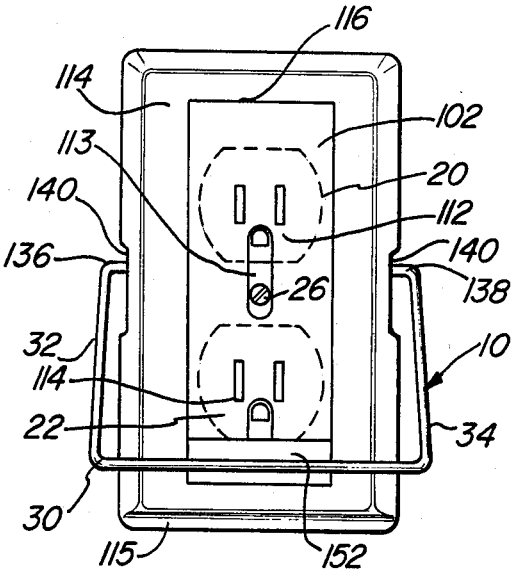

The operation of the safety device 100 is easily understood referring to FIGS. 6A and 6B. The mask plate 102 is normally in the lower or closed position as shown in FIG. 6A. In this position, retaining bar 30 snaps under peripheral edge 115 to lie flat against the wall 18. Projections 136, 138 and brackets 144 are at the lowermost points of elongated recesses 140 and spaces 142 respectively. Recess space 150 appears at the top of cover. Hole groupings 112 and 114 are out of alignment with the holes of sockets 20, 22. Thus, the safety device 100 prevents inadvertent use of the electrical outlet.

To use the electrical outlet, the retaining bar 30 is unsnapped from the lower peripheral edge 115 and bracket 10 is lifted upwards. Upward motion of the bracket 10 causes the mask plate 102 to slide to the top of the recess 116, by virtue of the continuity between projections 136, 138 and the brackets 144. The brackets 144 and the projections 136, 138 are at the top most portion of space 142 and elongated recess 140, respectively, and recess space 152 appears at the bottom of the cover plate 114 (see FIG. 6B). In this position, hole groupings 112 align with the holes in sockets 20, 22, thus permitting insertion of the prongs of plug 24 and the bracket 10 is available for use as a plug retainer as previously described. In either the closed or open position, elongated hole 113 allows access to the mounting bolt 26.

Thus, it will be understood that the present invention provides a retaining bracket which resists forces applied to electrical cords which tend to pull the plug from an electrical housing socket in which it is inserted. Moreover, the retaining bar can be pivoted to lie flush against a building wall adjacent the periphery of the cover plate to avoid obstruction with the area adjacent the wall. Nevertheless, the retaining bracket is simple to construct and install without substantial modification of the cover plate and it effectively prevents inadvertant removal of the plug from the socket when the electrical cord is tensioned by movement of the appliance away from the electrical socket housing. An alternative cover plate provides a safety device which prevents inadvertent use of the electrical outlet.

Having thus described the present invention, many modifications thereto will become apparent to those skilled in the art to which it pertains without departing from the scope and spirit of the present invention as defined in the appended claims.

What is claimed is:

1. A plug retainer for wall mounted electrical outlets having receptacles and a cover plate engaging a peripheral wall portion of a wall panel, said plug retainer comprising:

a retaining bracket comprising a retaining bar having two ends, each of which is attached to a first end of one of a pair of substantially parallel legs, said legs also having a free end and means for pivotably securing the free end of each leg so that the retaining bracket pivots with respect to said cover plate.

2. The invention as defined in claim 1 wherein said means for pivotably securing comprises an inwardly extending projection at the free end of each leg, and means for entraining each said projection intermediate said cover plate and said peripheral wall portion.

3. The invention as defined in claim 2 wherein said entraining means comprises a recess in opposing edges of said cover plate.

4. The invention as defined in claim 1 wherein said retaining bar conforms to the peripheral shape of said cover plate.

5. The invention as defined in claim 4 wherein said retaining bar is displaceable between at least a first position, in which said retaining bar frictionally engages a peripheral edge of said cover plate closely adjacent said wall panel, and a second position in which said retaining bar is positioned outwardly from said cover plate.

6. The invention as defined in claim 1 wherein said retaining bar includes means for selectively engaging an electrical cord.

7. The invention as defined in claim 6 wherein said means for selectively engaging an electrical cord comprises a resilient body having semi-circular projections defining a channel adapted to tightly engage the periphery of said cord, whereby said projections can be resiliently deflected for insertion of the cord into the channel, and means for mounting said resilient body to said retaining bar.

8. The invention as defined in claim 7 wherein said body mounting means comprises a resilient body portion adapted to tightly engage the periphery of said retaining bar.

9. The invention as defined in claim 1 and further comprising a reinforcement plate secured intermediate said cover plate and said means for pivotably securing.

10. The invention as defined in claim 2 and wherein said means for entraining comprises a reinforcement plate positioned intermediate said cover plate and said peripheral wall portion, and wherein said inwardly extending projections are dimensioned to extend behind said reinforcement plate.

11. The invention as defined in claim 1 wherein said cover plate includes means for attaching said plate to said electrical outlet and wherein said means for pivotably securing is aligned with said means for attaching said plate to said electrical outlet.

12. The invention as defined in claim 1 and further comprising masking means disposed adjacent said cover plate and movable between at least a first position, in which said masking means permits access to the receptacles of said electrical outlets, and a second position in which said masking means prevents access to the receptacles.

13. The invention as defined in claim 12 wherein said masking means comprises a rectangular mask plate slidably disposed in a rectangular recess in said cover plate.

14. The invention as defined in claim 13 wherein said mask plate contains groups of holes such that, in said first position, the holes align with the receptacles of the electrical outlets, and in said second position the holes are out of alignment with said receptacles.

15. The invention as defined in claim 12 wherein said means for pivotably securing comprises elongated recesses in opposing peripheral edges of said cover plate, and mounting means disposed on said masking means, said mounting means pivotally receiving the free ends of said retaining bracket legs.

16. The invention as defined in claim 15 wherein said means for moving the masking means between said first and second positions comprise the retaining bracket, slidably disposed in said elongated recesses.

17. A device for an electrical outlet having at least one electrical socket with receptacles and a cover plate, said device comprising:

masking means movably disposed closely adjacent said cover plate; and means for moving said masking means between at least a first position, in which said masking means permits access to said receptacles, and a second position, in which said masking means prevents access to said receptacles;

wherein said means for moving the masking means comprises elongated recesses in opposing peripheral sides of said cover plate; mounting means disposed on said masking means; and handle means having two free ends adapted to be slidably inserted through said elongated recesses and pivotally inserted into said bracket means, whereby a force on said handle means causes said masking means to shift from said first to said second position.

18. The invention as defined in claim 17 wherein said masking means comprises a rectangular mask plate slidably disposed in a rectangular recess in said cover plate.

19. The invention as defined in claim 18 wherein said mask plate contains groups of holes such that, in said first position, the holes align with the receptacles of said electrical sockets, and in said second position, the holes are out of alignment with said receptacles.

20. A plug retainer for wall mounted electrical outlets having receptacles and a cover plate engaging a peripheral wall portion of a wall panel, said plug retainer comprising:

a retaining bracket comprising a retaining bar having two ends, each of which is attached to a first end of one of a pair of substantially parallel legs, said legs each also having a free end; and means for pivotably securing the free end of each leg so that the retaining bracket pivots with respect to said cover plate and wherein said means for pivotably securing comprises an inwardly extending projection at the free end of each leg, and means for entraining each said projection intermediate said cover plate and said peripheral wall portion.

* * * * *